US005288079A

United States Patent [19]

Katayama

[11] Patent Number: 5,288,079

[45] Date of Patent: Feb. 22, 1994

[54] GOLF WOOD CLUBHEAD

[75] Inventor: Yotaka Katayama, Tokyo, Japan

[73] Assignee: Maruman Golf Kabushiki Kaisha, Tokyo, Japan

[21] Appl. No.: 797,824

[22] Filed: Nov. 27, 1991

[30] Foreign Application Priority Data

Nov. 29, 1990 [JP] Japan ..... 2-325551

[51] Int. Cl.[5] ..... A63B 53/04

[52] U.S. Cl. ..... 273/167 A; 273/167 E

[58] Field of Search ..... 273/167-175, 273/77 R, 77 A, 164, 183 D, 186 A, 193 R, 194 R, 164.1, 79

[56] References Cited

U.S. PATENT DOCUMENTS

| | | | |
|---|---|---|---|
| 1,096,359 | 5/1914 | Dwight | 273/169 |
| 1,396,470 | 11/1921 | Taylor | 273/77 R |
| 1,528,017 | 3/1925 | Gammeter | 273/167 E |
| 1,555,425 | 9/1925 | McKenzie | 273/167 E |
| 1,587,758 | 6/1926 | Charavay | 273/167 E |
| 1,617,090 | 2/1927 | Worthington | 273/169 X |
| 1,638,916 | 8/1927 | Butchart | 273/169 |
| 2,169,774 | 8/1939 | Taylor | 273/72 R |
| 2,705,147 | 1/1952 | Winter | 273/167 R X |
| 3,250,536 | 5/1966 | Moser | 273/169 X |
| 3,743,297 | 7/1973 | Dennis | 273/175 X |
| 3,845,955 | 11/1974 | Solheim | 273/77 A |
| 4,247,105 | 1/1981 | Jeghers | 273/77 A |
| 4,896,885 | 1/1990 | Kajita et al. | 273/167 H |
| 5,092,599 | 3/1992 | Okumoto et al. | 273/164 |

FOREIGN PATENT DOCUMENTS

| | | | |
|---|---|---|---|
| 1063798 | 3/1967 | United Kingdom | 273/167 A |

*Primary Examiner*—Jessica J. Harrison
*Assistant Examiner*—Sebastiano Passaniti
*Attorney, Agent, or Firm*—Armstrong, Westerman, Hattori, McLeland & Naughton

[57] ABSTRACT

A golf wood clubhead has a body having face and sole portions which define a leading edge therebetween. The width from the leading edge of the head body to the rear end of the sole portion is nearly equal to or less than a half of the width from the leading edge of the head body to the rear end thereof. The head body may have a rounded lower back portion of a certain radius of curvature within a region from the rear end of the sole portion to the rear end of the head body. The sole portion may have a rounded surface of the same radius of curvature as that of the rounded lower back portion.

3 Claims, 3 Drawing Sheets

GOLF WOOD CLUBHEAD

BACKGROUND OF THE INVENTION

1. Field of the Invention

The present invention relates to golf wood clubheads. It is to be understood that golf wood clubheads according to the invention are not limited to those made of wood but include those made of other materials such as synthetic resins, metals or the like. More particularly, the invention relates to a golf wood clubhead having a specific outer shape for reducing the contact resistance between the sole portion and the ground or turf.

2. Description of Related Art

Generally, a golf wood clubhead having a head body is brought into contact at the sole portion thereof with the ground or turf when striking the golf ball. Therefore, it is generally difficult to execute a good swing, and the head speed is apt to be reduced due to generation of contact resistance between the sole portion of the head body and the ground or turf. On the other hand, if the head body of the clubhead strikes the ground just before the golf ball, which is so called "duffing", the head body is apt to receive a great reaction force at the sole portion thereof from the ground, thus resulting in the bouncing of the head body and the deviation of the swing orbit.

In order to reduce the contact resistance on the sole portion, there has been proposed a golf wood clubhead in which the width $l_2$ from the leading edge of the head body to the rear end of the sole portion thereof is made smaller than the overall width $l_1$ from the leading of the head body to the rear end thereof, as shown in FIG. 5. However, in such a proposed wood clubhead, since the difference between the sole width $l_2$ and the overall width $l_1$ of the head body is relatively small, i.e., $l_2 \frac{1}{2} \times l_1$, and the sole portion has a generally flat surface, the above drawback has not been sufficiently overcome.

SUMMARY OF THE INVENTION

It is therefore an object of the present invention to provide a golf wood clubhead which makes it possible to easily execute a stable club swing.

Another object of the invention is to provide a golf wood clubhead which makes it possible to reduce a contact resistance between the sole portion and the ground or turf.

A further object of the invention is to provide a golf wood clubhead which makes it possible to reduce the possibility of generation of duffing.

According to the present invention, the above-mentioned objects can be achieved by a golf wood clubhead comprising a head body having face and sole portions which define a leading edge therebetween, wherein the width from the leading edge of the head body to the rear end of the sole portion is nearly equal to or less than a half of the width from the leading edge of the head body to the rear end thereof.

In the golf wood clubhead having the above-mentioned construction, since the sole width, i.e., the width from the leading edge to the rear end of the head body is nearly equal to or less than a half of the overall width of the head body, contact or frictional resistance between the sole portion and the ground or turf during the forward swing can be greatly reduced due to the reduction of an area of the sole portion. Accordingly, the clubhead according to the invention makes it possible to execute a stable swing without a great reduction of the head speed.

The duffing means a phenomenon that the sole portion of the clubhead strikes the ground just before the ball resting on the ground or turf, causing the deterioration of the swing orbit or directivity of the clubhead and reducing the head speed due to the reaction force applied thereto from the ground. The clubhead according to the invention can reduce the possibility of generation of the duffing by virtue of reduction of the area of the sole portion.

Preferably, the head body has a rounded lower back portion of a certain radius of curvature within a region from the rear end of the sole portion to the rear end of the head body. According to this construction, contact resistance between the head body and the ground or turf as well as the possibility of generation of the duffing can be reduced moreover.

In the case that the head body has the above-mentioned rounded lower back portion, the sole portion may have a rounded surface of the same radius of curvature as that of the rounded lower back portion within a region from the leading edge of the head body to the rear end of the sole portion. Preferably, the rounded sole and the rounded lower back portion together constitute a common rounded surface. According to this construction, contact resistance between the surface of the head body and the ground or turf as well as the possibility of duffing can be decreased more greatly.

Alternatively, in the case that the head body has the above-mentioned rounded lower back portion, the sole portion may have a generally flat surface which continuously connected at the rear end thereof with the rounded lower back portion. In this case, preferably, the leading edge of the head body is formed as a curved edge.

Preferably, the head body has a generally flat top portion extending from the upper edge of the face portion to the rear end of the head body. According to this construction, air resistance on the surface of the top portion can be reduced during the swing, and therefore it is possible to increase the head speed and maintain the stability of orientation of the clubhead. Accordingly, the clubhead can be very readily swung even if it is used by beginners.

Further, the overall head body may have a rearward projecting shape. In this case, preferably, the overall width between the leading edge of the head body and the rear end thereof is made larger than that between the heel and toe ends of the head body. According to these construction, the depth of the center of gravity of the clubhead from the face portion can be increased. Accordingly, the loft angle of the clubhead can be increased at the time of the impact, thus permitting ready flying of the ball.

These and other objects, features and advantages of the present invention will become apparent from the following detailed description of the preferred embodiments with reference to the drawings.

DETAILED DESCRIPTION OF THE PREFERRED EMBODIMENTS

Figure 1:
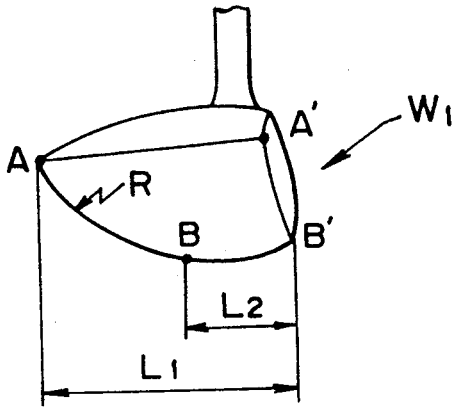
FIG. 1 is a perspective view of a golf wood clubhead showing a first embodiment of the present invention viewed from the toe side.
Figure 2:
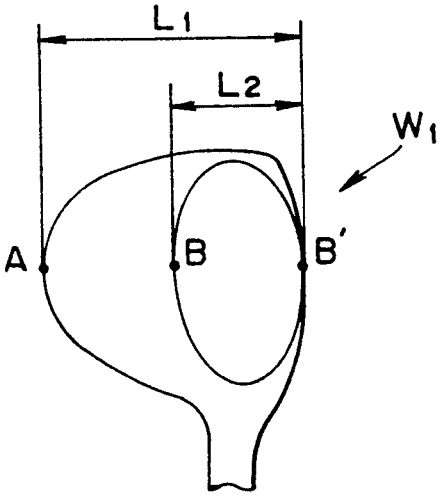
FIG. 2 is a plan view of the clubhead shown in FIG. 1 viewed from the bottom side.

FIGS. 1 and 2 show a golf wood club head of a first embodiment of the present invention. Referring to these Figures, the clubhead has a head body $W_1$ which is connected at the heel end thereof with a neck. It is the most important feature of the clubhead that the overall width $L_1$ of the head body $W_1$, i.e., the length from the leading edge B' of the head body to the rear end A thereof, and the width $L_2$ of the sole portion thereof, i.e., the length from the leading edge B' to the rear end B of the sole portion satisfy the following relation:

$$L_2 \leqq \tfrac{1}{2} \times L_1.$$

Figure 3:
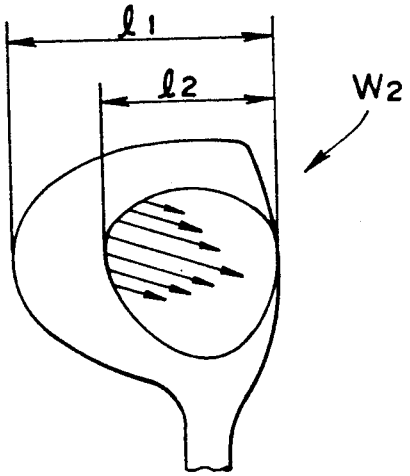
FIG.3 (Prior Art)
FIG. 3 is a view similar to FIG. 2 but showing a prior art golf wood clubhead.

FIG. 3 shows a conventional golf wood clubhead. In the conventional clubhead, the overall width $l_1$ of the clubhead $W_1$ and the width $l_2$ of the sole portion, corresponding to those of the above-mentioned embodiment, are related as $l_2 < l_1$, but the difference between the two widths is small, i.e., $l_2 > \frac{1}{2} \times l_1$. Therefore, when the swing is executed with the conventional clubhead, the sole portion receives a great contact resistance from the ground or turf, as shown by the arrows in FIG. 3. This may cause a great reduction of the head speed or a great deviation of the clubhead from the swing orbit. Further, in the case that the golfer's swing is not so stable, the so called "duffing" may often occur when hitting a ball, i.e., the clubhead may strike the ground just before the ball. At this time, the sole portion receives a great reaction force from the ground because of its large area, thus causing the clubhead to be bounded from the ground and resulting in an inaccurate hit.

With the provision of the above-mentioned specific relation between the head overall width $L_1$ and sole width $L_2$ of the clubhead according to the invention, the above drawbacks can be eliminated. That is, the contact resistance offered to the sole portion can be greatly reduced by virtue of the decreased area of the sole portion, and thus the clubhead according to the invention can be stably and smoothly swung.

Referring again to FIG. 1, the clubhead has a rounded lower back portion of radius R extending from the rear end B of the sole portion to the rear end A of the head body $W_1$, thus making it easy to execute a stable swing. The radius R of the rounded lower back portion between the points B and A may be nearly equal to or less than 250 mm, but it is not limited thereto.

In the embodiment shown in FIG. 1, the sole portion has a rounded surface of the same radius as that of the rounded lower back portion and is continuously connected at the rear end portion to the rounded lower back portion. This means that the sole portion and the lower back portion of the head body $W_1$ together creates a single rounded shape of radius R between the points B' and A. In this case, contact resistance between the sole portion and the ground or turf can be more greatly decreased by virtue of the integrated rounded shape including the sole portion and the lower back portion. Accordingly, it is possible to reduce more greatly the contact resistance offered to the lower surface of the head body from the ground or turf and thereby to increase the head speed during the forward swing.

Alternatively, the sole portion extending between the points B and B' of the head body $W_1$ may have a generally flat surface. In this case, preferably, only a leading edge B' of the head body $W_1$ is formed as a rounded edge.

In the first embodiment, the sole width $L_2$ may be varied within the range in which the above-mentioned relationship between the length $L_1$ and $L_2$ is ensured, but it should be such that the stability of the clubhead can be ensured when the clubhead is addressed.

Figure 4:
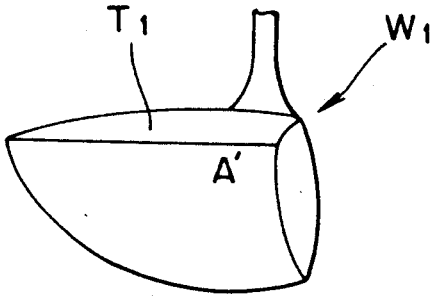
FIG. 4 is a perspective view of a golf wood clubhead showing a second embodiment of the present invention viewed from the toe side.
Figure 5:
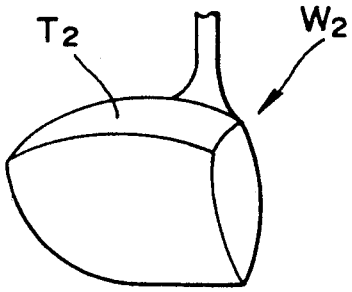
FIG. 5 (Prior Art)
FIG. 5 is a view similar to FIG. 4 but showing a prior art clubhead.

FIG. 4 shows a second embodiment of the present invention, in which the relationship between the sole width and the overall width of the head body $W_1$ is the same as that of the first embodiment, and in which the sole portion and the lower back portion has a common rounded shape of a certain radius. The head body $W_1$ shown in FIG. 4 is further characterized by the top portion $T_1$ thereof which has a generally flat surface between the upper edge of the face portion and the rear end of the head body. This means that if the clubhead of the second embodiment is designed such that the height of the head body (i.e., the height from the sole portion to the top portion $T_1$) is substantially the same as that of a conventional clubhead $W_1$ as shown in FIG. 5, it is possible to design the rear end portion of the head body $W_1$ so that the rear end portion projects rearward or sidewards more greatly in comparison to that of the conventional clubhead under the condition of the same clubhead volume, as apparent from FIGS. 4 and 5.

According to the construction of the second embodiment, it is possible to increase the area of the top portion $T_1$ of the head body $W_1$ in comparison to that of the conventional clubhead having a rounded top portion. In this case, the head body $W_1$ of the clubhead according to the second embodiment of the invention can be seemed to have a larger volume than that of the conventional clubhead having the same volume as that of the second embodiment when the clubhead is addressed, thus causing the player to feel safe. In addition, the depth of the center of gravity of the clubhead, i.e., the distance from the face portion to the center of gravity, is increased due to the partial transfer of mass of the head body from the top portion thereof into the rear end portion thereof. Such construction is effective to fly up the golf ball more readily, as will be described later in more detail.

Further, since the top portion $T_1$ of the second embodiment has a generally flat surface up to the rear end of the head body $W_1$, it is possible to generate air boundary separation at a region rearward from the head body $W_1$, thus resulting in the reduction of air resistance and increase of the head speed.

Figure 6:
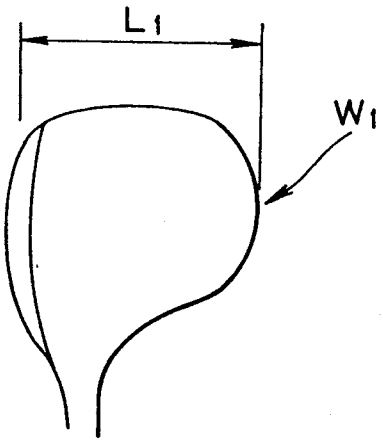
FIG. 6 is a perspective view of a golf wood clubhead showing a third embodiment of the present invention viewed from the top.

FIG. 6 shows a third embodiment of the present invention, in which the relationship between the sole width and the overall width of the head body $W_1$ is the same as that of the first embodiment, and in which the sole and the lower back portion has a common rounded shape of a certain radius.

Figure 7:
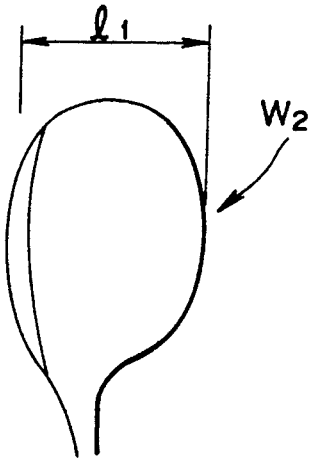
FIG. 7 (Prior Art)
FIG. 7 is a view similar to FIG. 6 but showing a prior art clubhead structure.

In the structure shown in FIG. 6, a feature resides in that the head body $W_1$ looked from the top has a peripheral configuration projecting rearward in comparison to that of a conventional head body $W_2$ as shown in FIG. 7. According to the structure of the third embodiment, it is possible to increase the depth of the center of gravity of the head body $W_1$, i.e., the depth from the face portion thereof to the center of gravity, in comparison to that of the conventional head body $W_1$.

Figure 8:
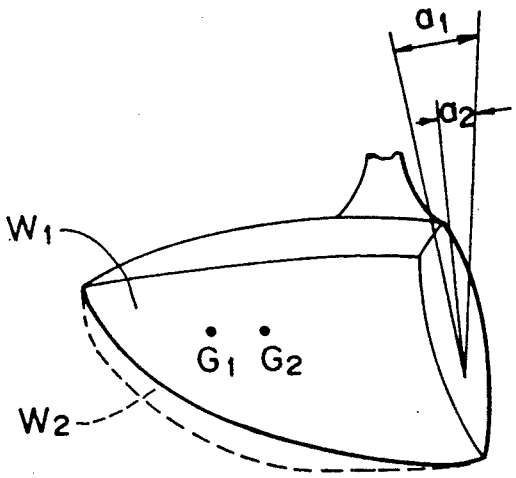
FIG. 8 is a view for explaining a relation between the position of the center of gravity and the loft angle of the clubhead at the time of the impact, in which the solid line represents the outer shape of the clubhead according to the invention while the dotted line represents the outer shape of the conventional clubhead.

FIG. 8 is a view for explaining a positional relationship of the center of gravity of the clubheads $W_1$ and $W_2$, in which the solid line represents the outer shape of the head body $W_1$ according to the invention, while the dotted line represents the outer shape of the conventional head body $W_2$.

With this positional relationship concerning the center of gravity, the head body $W_1$ according to the invention, in which the center of gravity $G_1$ exists more rearward from the center of gravity $G_2$ of the conventional head body $W_2$, can be rotated more readily in the counterclockwise direction in FIG. 8 while striking the ball. Thus, at the time of the impact the loft angle $a_1$ of the head body $W_1$ according to the invention is made larger than the loft angle $a_2$ of the conventional head body $W_2$ due to rotation of the head body, and thus the ball is more readily lofted up.

In the embodiments shown in FIGS. 4 and 6 having a rearward projecting shape, a dimensional relationship between the length from the heel to the toe of the head body $W_1$ and the width from the face portion to the rear end thereof may be such that the latter is nearly equal to or less than the former.

While the invention has been described in conjunction with specific embodiments thereof, it is evident that many alternatives and modifications will be apparent to those skilled in the art in light of the foregoing description. Accordingly, it is intended to include all such alternatives and modifications as fall within the spirit and scope of the appended claims.

What is claimed is:

1. A golf clubhead comprising a head body having a face portion which has lower and upper edges and is inclined to define a predetermined loft angle with respect to the ground, a rounded sole portion which has front and rear ends and is connected at the front end thereof to the lower edge of the face portion, thereby defining therebetween a leading edge of the head body, a generally flat top portion which has a front end and a rear end and is connected at the front end thereof to the upper edge of the face portion, the rear end of the top portion being opposed from the face portion and defining a rear end of the head body, and a rounded lower back portion which extends between the rear end of the sole portion and the rear end of the top portion, wherein the width from the leading edge of the head body to the rear end of the sole portion is nearly equal to or less than a half of the width from the leading edge of the head body to the rear end of the top portion, wherein the sole portion is downwardly convex between the front and rear ends thereof and is also of the same radius of curvature as that of the rounded lower back portion, and wherein the top portion is formed so as to extend substantially in parallel to the ground when the clubhead is brought into address on the ground.

2. The golf wood clubhead according to claim 1, wherein the head body has a rearward projecting shape.

3. The golf wood clubhead according to claim 2, wherein the head body has a heel end and a toe end and the width from the leading edge of the head body to the rear end of the top portion is nearly equal to or less than the length between the heel and toe ends of the head body.

* * * * *